United States Patent [19]

Takeda et al.

[11] Patent Number: 4,878,628

[45] **Date of Patent: * Nov. 7, 1989**

[54] COIL WINDING MACHINE HAVING A TAPE WINDER

[75] Inventors: Kyoji Takeda; Yoji Suekane, both of Tokyo, Japan

[73] Assignee: Tanaka Seiki Co., Ltd., Tokyo, Japan

[ * ] Notice: The portion of the term of this patent subsequent to Sep. 1, 2004 has been disclaimed.

[21] Appl. No.: 192,311

[22] Filed: May 10, 1988

[30] Foreign Application Priority Data

May 12, 1987 [JP] Japan ..... 62-115197
May 12, 1987 [JP] Japan ..... 62-70294[U]
Dec. 18, 1987 [JP] Japan ..... 62-192455[U]

[51] Int. Cl.[4] ..... B65H 19/20; H01F 41/12
[52] U.S. Cl. ..... 242/7.08; 242/56 R
[58] Field of Search ..... 242/7.08, 7.23, 7.15, 242/56 R, 195; 156/530, 570, 516, 285, 447, 478, 492, 493; 53/214

[56] References Cited

U.S. PATENT DOCUMENTS 2,571,243 10/1951 Hooker ..... 242/7.15 X
3,253,794 5/1966 Twigg ..... 242/7.08
3,970,259 7/1976 Schmid ..... 242/7.08
4,196,863 4/1980 Sakaue ..... 242/7.08
4,531,689 7/1985 Beach et al. ..... 242/195
4,635,869 1/1987 Woodley ..... 242/195 X
4,690,346 9/1987 Takeda et al. ..... 242/64

FOREIGN PATENT DOCUMENTS 1481315 7/1977 United Kingdom .
1554503 10/1979 United Kingdom .

*Primary Examiner*—Joseph J. Hail, III
*Attorney, Agent, or Firm*—Spencer & Frank

[57] ABSTRACT

A coil winding machine having a tape winder base which is movable at least vertically and is capable of effecting coil winding and taping operation on a continuous basis. A plurality of tape winding mechanisms are installed on the tape winding base, and each is provided with a tape support, a tape guide mechanism, a pad for pressing the tape against a coil, and a cutter for cutting the tape. The tape guide mechanism, the pad and the cutter constitute a taping head, and each taping head is installed detachably on a taping head support secured to the tape winder base. The tape winder base is movable in the horizontal direction as well as vertically. In this case, the ratio of the number of tape winding mechanisms can be set to one to an integer of the number of spindles.

7 Claims, 9 Drawing Sheets

COIL WINDING MACHINE HAVING A TAPE WINDER

BACKGROUND OF THE INVENTION

The present invention relates to a coil winding machine, and more particularly to a coil winding machine integrally incorporating a tape winder adapted to wind an external tape around a coil for which coil winding has been completed or an internal tape around a coil which is in an intermediate stage of coil winding, making it possible to automatically effect coil winding and taping on a consistent basis.

Coil winding is generally effected automatically using a coil winding machine, while the operation of winding an external tap around a coil for which winding has ben completed has also been automated. The efficiency of both the coil winding and tape winding has been improved appreciably by automation, and labor-saving efforts have been made in these areas. However, the transfer of coils between the coil winding machine and the tap winder needs to be effected manually or by using a conveying machine. Furthermore, the manual operations of attaching coils to and detaching the same from the coil winding machine as well as attaching coils to and detaching the same from the tape winder are required. For this reason, it has been impossible to completely automate the integrated operation of coil winding, and there has been much waste in terms of time, labor and space.

Accordingly, an object of the present invention is to provide a coil winding machine which is capable of automatically effecting continuously with a coil winding operation an operation of winding an external tape around a coil for which coil winding has been completed or an operation of winding an internal tape around a coil which is in an intermediate stage of winding by incorporating a tape winder in the coil winding machine, thereby overcoming the above-described drawbacks of the prior art.

Another object of the present invention is to provide a coil winding machine in which one set of tape winding mechanisms can effect tape winding around coil bobbins installed on a plurality of spindles.

A further object of the present invention is to provide a tape winding mechanism for a coil winding machine in which taping heads can be replaced quite readily or can be installed with their orientations varied in correspondence with various kinds of coils.

SUMMARY OF THE INVENTION

To these ends, according to the present invention, there is provided a coil winding machine having a tape winder, comprising: a plurality of rotatable spindles which are capable of holding coil bobbins; nozzle holder supports for supporting a nozzle holder holding a plurality of nozzles for guiding wires to the coil bobbins; a tape winder base which is installed in such a manner as to be movable at least vertically relative to the nozzle holder; and at least one tape winding mechanism provided on the base, the tape winding mechanism including a tape support for supporting a tape, a tape guide mechanism including a plurality of rollers, a pad for pressing the tape against a coil disposed on the coil bobbin, and a retractable cutter which is provided adjacent to the pad.

Specifically, the tape winder base may be movable horizontally and vertically.

More specifically, an intermediate support plate may be provided on the nozzle holder supports in such a manner as to be vertically movable. The tape winder base can be attached to this intermediate support plate in such a manner as to be horizontally movable.

In accordance with this aspect of the present invention, the taping operation can be effected on a continuous basis with the coil bobbins installed on the spindles after the coil winding operation. Accordingly, it is not necessary to prepare a tape winder separately in addition to the coil winding machine as has hitherto been the case, and it is not necessary to manually effect the loading, unloading, and conveyance of coils between the coil winding machine and the tape winder. As a result, it is possible to automatically effect an integrated operation of coil winding and tape winding within a short period of time. In particular, there is a large effect when an internal tape is wound during the interim period between a coil winding operation and an additional coil winding operation.

The number of tape winding mechanisms is preferably one to an integer of the number of spindles. Hence, as the base is moved consecutively in the horizontal direction, a tape winding operation can be performed for a plurality of spindles using one tape winding mechanism. If this arrangement is adopted, it is possible to effect tape winding on a multiplicity of spindles (a number which is an integer-fold the number of supply tape rolls) disposed with a high density by using large-diameter supply tape rolls in which long tapes have been wound around tape bobbins.

In addition, in accordance with another aspect of the present invention, there is provided a tape winding mechanism comprising: a tape support provided on a base which is movable to at least an arbitrary position within a plane perpendicular to a rotatable spindle which is capable of holding a coil bobbin; a taping head support secured to the base and provided with a hole; a taping head including a pad for pressing a tape against a coil wound around the coil bobbin, the pad having a plurality of air holes communicating with a pad surface, a bar-shaped projection which is capable of fitting with the hole of the taping head support and having an air suction hole which is capable of communicating with the air holes, a tape guide portion having a plurality of rollers, and a cutter which is provided adjacent to the pad and is capable of advancing and retracting with respect to the pad; and means for allowing the taping head to engage detachably with the taping head support.

With such a tape winding mechanism, since the taping heads are detachable, even if the type of winding tape differs, e.g. even if the width of the tape or the winding direction of the tape differs, it is possible to readily cope with such a situation by replacing the taping head or by changing the direction of orientation thereof. Accordingly, the operational efficiency of production of a large variety of coils in small quantities can be enhanced.

These and other objects, features and advantages of the present invention will become apparent from the following detailed description of the present invention when read in conjunction with the accompanying drawings.

DETAILED DESCRIPTION OF THE PREFERRED EMBODIMENTS

Figure 1:
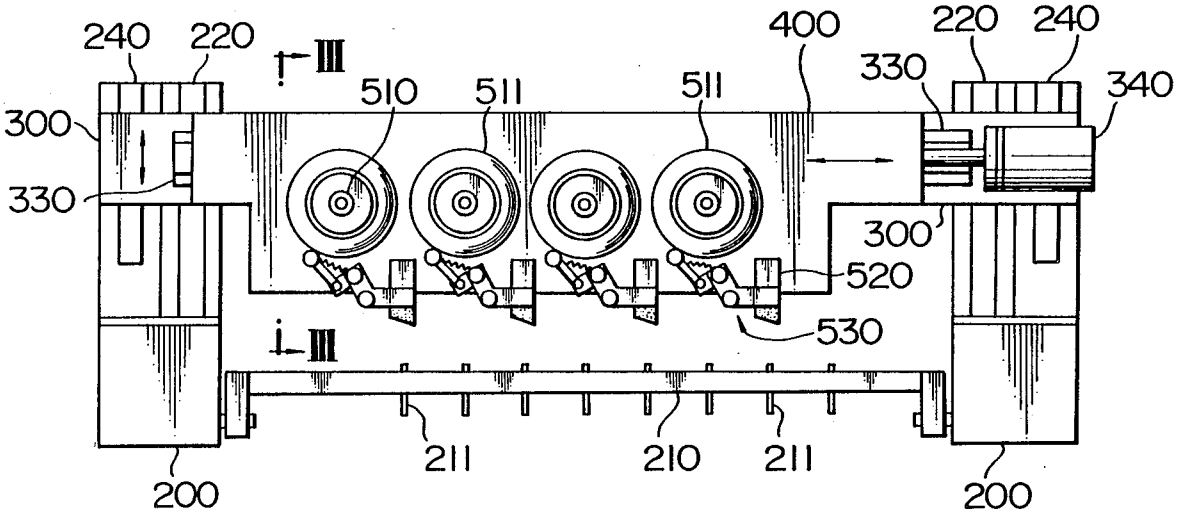
FIG. 1 is a front elevation view of an embodiment of a coil winding machine in accordance with the present invention.
Figure 3:
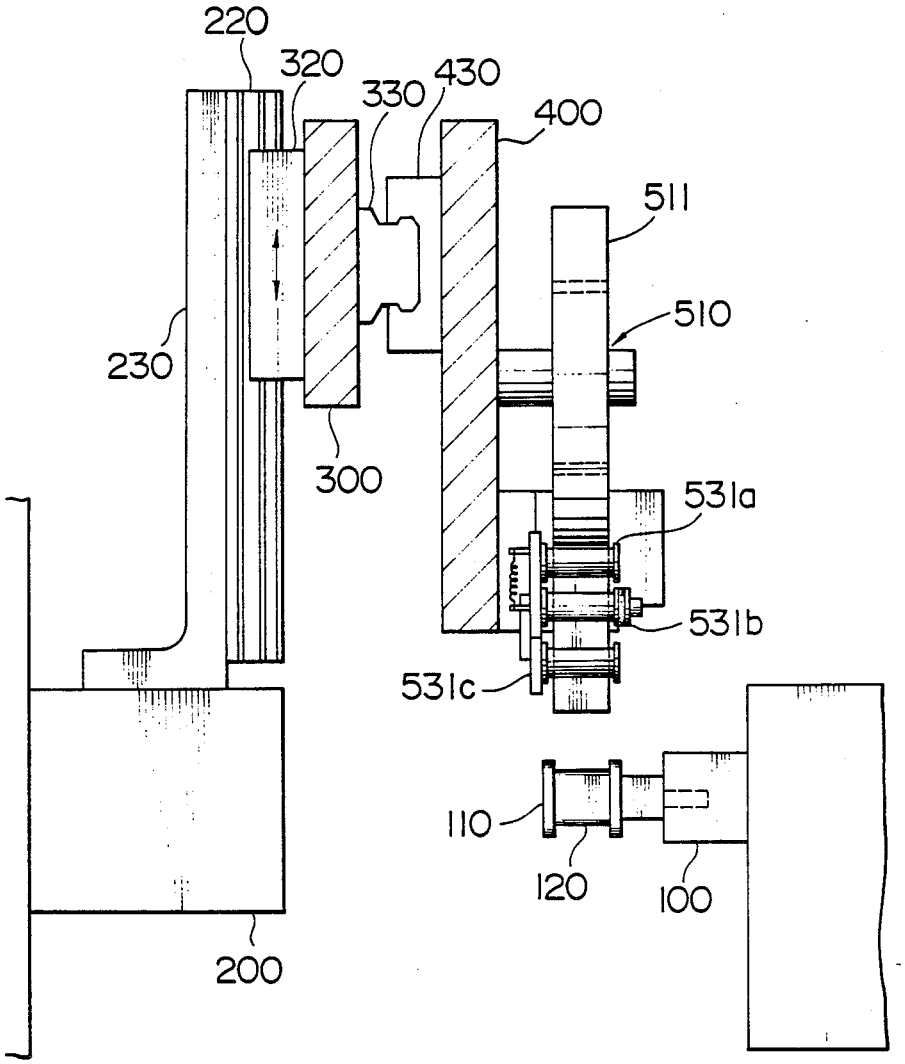
FIG. 3 is a side sectional view taken along the line III—III of FIG. 1.

In FIGS. 1 and 3, an intermediate support plate 300 which serves as an intermediate for securing a tape winder base 400 is installed on a pair of nozzle holder supports 200 via sliders 220 and 320 and a slider installing member 230 in such a manner as to be vertically movable. A pair of rodless cylinders 240 are installed adjacent to the sliders 220 and 320. As the rodless cylinders 240 are driven, the intermediate support plate 300 moves vertically. The tape winder base 400 is installed on the intermediate support plate 300 via sliders 330 and 430 in such a manner as to be longitudinally movable.

In addition, an air cylinder 340 is installed on the intermediate support plate 300, and the tape winder base 400 is adapted to move longitudinally on the intermediate support plate 300 as the air cylinder 340 is driven.

Figure 2:
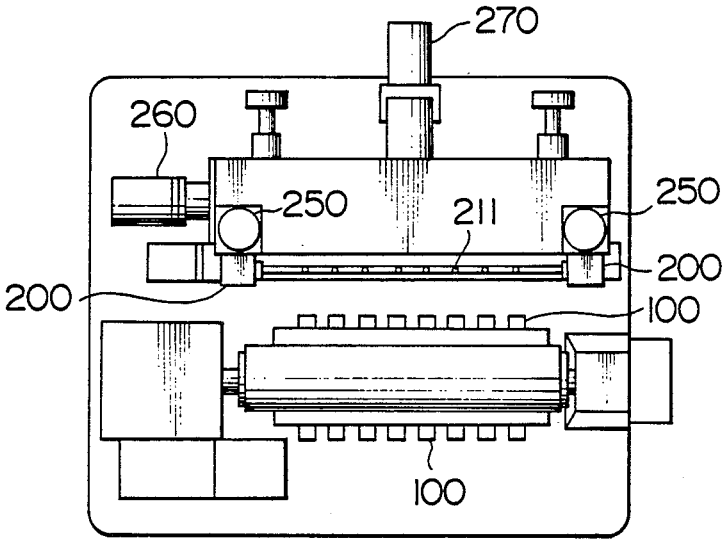
FIG. 2 is a schematic top plan view of the embodiment shown in FIG. 1, illustrating a state before an intermediate support plate is installed.

The nozzle holder supports 200 support a nozzle holder 210 which holds nozzle 211 in such a manner as to change the direction of the axes of all the nozzles 211 simultaneously through 90 degrees and is capable of moving transversely, horizontally and vertically in such a manner as to be capable of varying the positions of the nozzles 211, as desired, with respect to opposing spindles 100. All winding and taping operations, which requires this movement of the nozzle holder 210, are controlled by control units (not shown) and are effected by motors 250, 260 and 270 shown in FIG. 2.

The reasons why the intermediate support plate 300 is adapted to be capable of moving vertically is because the winding mechanisms are retracted upwardly so that they will not cause a hindrance mainly during winding or when binding processing of a coil terminal is carried out. This vertical movement of the intermediate support plate 300 is effected by the rodless cylinders 240. In addition, the reason why the tape winder base 400 is adapted to be capable of longitudinal movement is because the longitudinal movement of the tape winder base 400 in combination with the vertical movement of the intermediate support plate 300 allows the tape winding mechanism to assume any two-dimensional position relative to the spindles 100. The longitudinal movement of the tape winder base 400 is effected by the air cylinder 340. By virtue of this two-dimensional movement, taping can be effected around all coils mounted on the spindles 100 for which winding has been completed or which are in an intermediate stage of winding, by using tape winding mechanisms of a number which is one to an integer of the number of the spindles 100. In other words, taping tape cutting, and shaping of an end of a tape wound on a coil can be effected for two or more spindles by moving the tape winding mechanism from the position of one spindle 100 to the position of an adjacent spindle 100.

Figure 4:
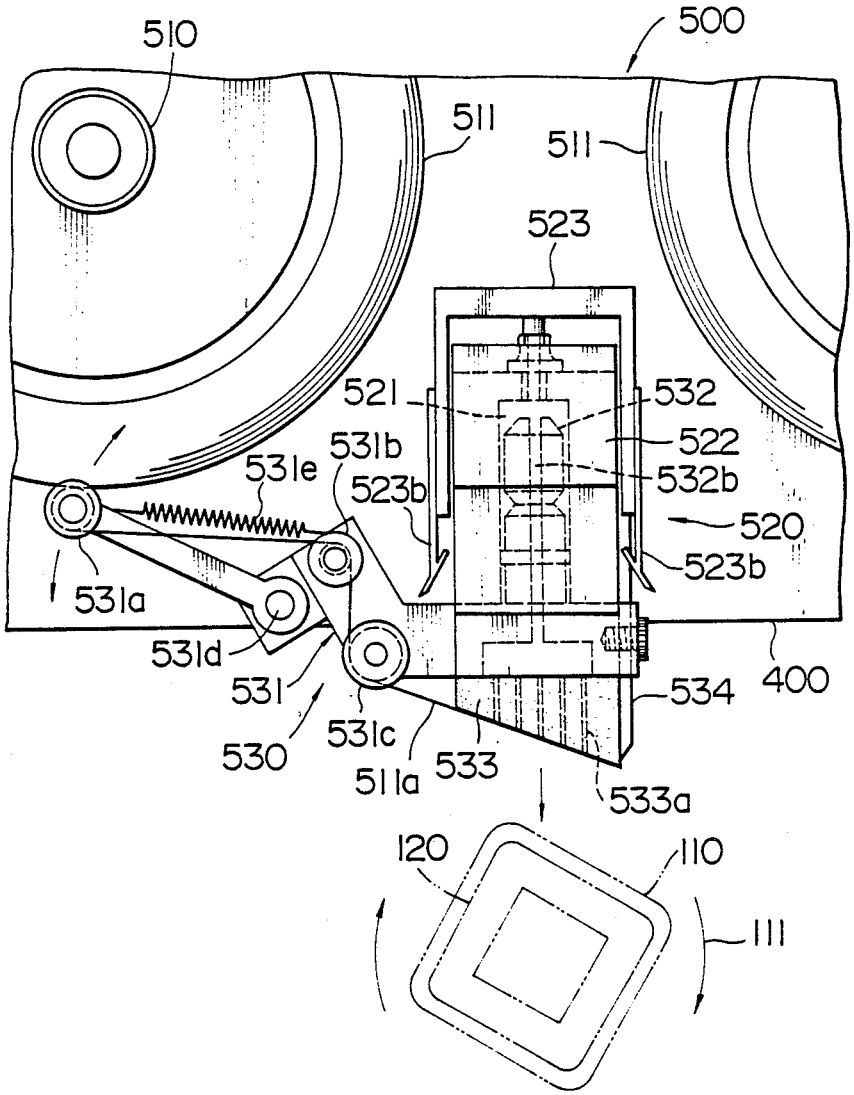
FIG. 4 is an enlarged front elevational view of an essential portion of the embodiment shown in FIG. 1.
Figure 5:
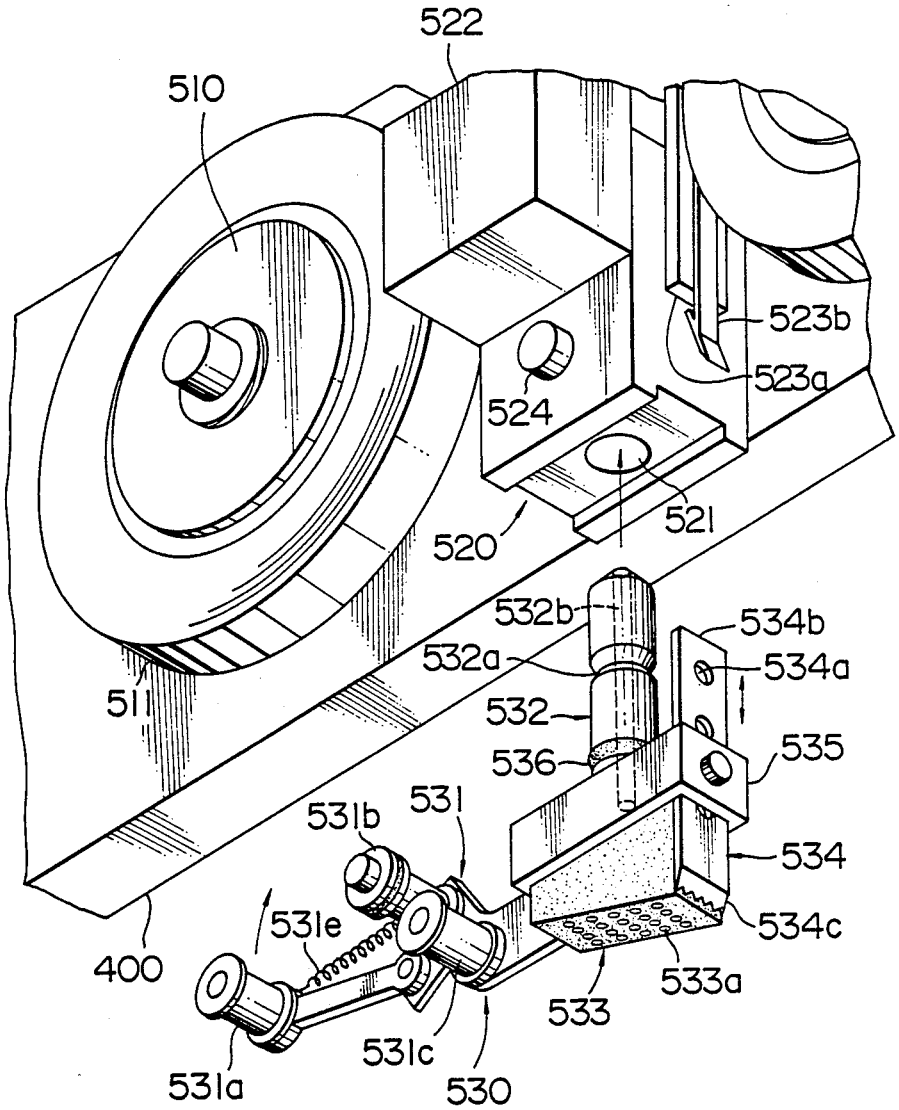
FIG. 5 is a perspective view illustrating a state in which the essential portion shown in FIG. 4 is viewed upwardly from diagonally below.

The tape winder base 400 is provided with tape winding mechanisms 500 as shown in FIG. 4. Each of the tape winding mechanisms 500 comprises a tape support 510, a taping head support 520 and a taping head 530. Referring to FIGS. 4 and 5, a hole 521 fitting with a bar-shaped projection 532 of the taping head 530 is provided in the taping head support 520. In addition, an air cylinder 522 and a U-shaped cutter driving plate 523 (FIG. 4) which is adapted to advance and retract are provided in the taping head support 20. An engaging portion 523*b* having a claw which engages with a hole 534*a* of a cutter 534 is provided at each tip 523*a* of the cutter driving plate 523. This cutter driving plate 523 and the engaging portions 523*b* are driven by the air cylinder 522 and effect advancing and retracting operations. Incidentally, an accommodating portion 524 accommodates a ball (not shown) which fits with an annular groove 532*a* of the bar-shaped projection 532 as well as a spring (not shown) which presses the ball against the bar-shaped projection 532.

The taping head 530 includes the following: a tape guide mechanism 531 consisting of guide rollers 531*a* and 531*c* and a tension roller 531*b*; a pad 533 fixed to part of the tape guide mechanism 531; a cutter 534 installed along a side surface of the pad 533 in such a manner as to be retractable; and the bar-shaped projection 532, which fits with the hole 521 of the taping head support 520 and has air sucking through hole 532*b* within it.

The guiding roller 531*a* which is installed at the tip of the tape guide mechanism 531 is capable of moving freely around a pivot 531*d* and is constantly pressed by the tension of a spring 531*e* against an outer peripheral surface of a tape 511 supported by the tape support 510 so as to keep the tape 511 held constantly in place. The guide rollers 531*a* and 531*c* are capable of rotating smoothly and freely, while the tension roller 531*b* has rotational friction which is adjustable. The tension roller 531*b* applies brakes to the traveling of the tape 511 passing it so as to impart an appropriate degree of tension to the tape 511 which will be attached to the coil surface.

The pad 533 is provided with a multiplicity of fine holes 533*a* passing from its surface which will be in contact with the tape 511 to the rear side, and the air in the vicinity of the surface of the pad 533 is sucked by a vacuum pump (not shown) via these fine holes 533*a* and air sucking hole 532*b* penetrating the inside of the bar-shaped projection 532 so as to generate negative pressure. Accordingly the tape 511 can be sucked and held on the pad 533 as required.

The cutter 534 is installed in such a manner as to slide through the inside of the cutter guide portion 535 along a side surface of the pad 533. A hole 534*a* is provided in the vicinity of an upper portion of the cutter 534 and fits and engages with either of the left-and right-hand side engaging portions 523*b* of the U-shaped cutter driving plate 523 which is driven by the air cylinder 522. When the tape 511 is cut, the tip 523*a* of the cutter driving plate 523 pushes an uppermost portion 534*b* of the cutter 534, so that a blade 534*c* is lowered and cuts the tape 511 disposed at a horizontal posture.

The bar-shaped projection 532 is provided with the above-described air suction hole 532*b*, the annular groove 532*a* for locking the ball (not shown) which projects inwardly of the hole 521 of the taping head support 520 and a groove for fitting with a resilient O-ring for maintaining air-tightness of the sucked air.

In this embodiment, the taping head 530 is formed into a unit and is provided detachably on the taping head support 520. However, the taping head 530 may be fixed to the tape winder base 400.

Since the structures and operation of the spindles 100 and their driving mechanisms are identical with those of a conventional automatic coil winding machine, a description thereof will be omitted.

A description will now be given of a tape winding operation in accordance with this embodiment.

Figure 6A:
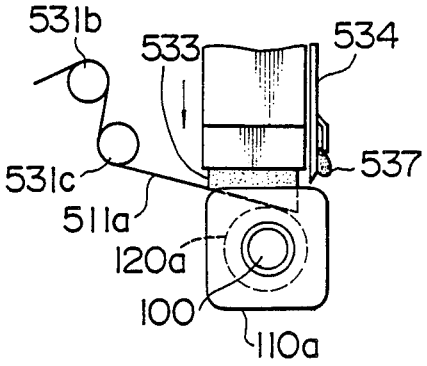
FIGS. 6*a* the 6*d* are diagrams illustrating a tape winding operation in accordance with the embodiment shown in FIG. 1.

In FIG. 6*a*, a coil bobbin 110*a* is installed on the spindle-100, a coil 120*a* has already been wound therearound, and the binding processing of a terminal thereof has also been completed. The pad 533 is disposed in a plane perpendicular to the central axis of the spindle 100 (in the state shown in FIG. 4), and an end 511*a* of the tape 511 is pulled out to the position of the pad 533.

Figure 7:
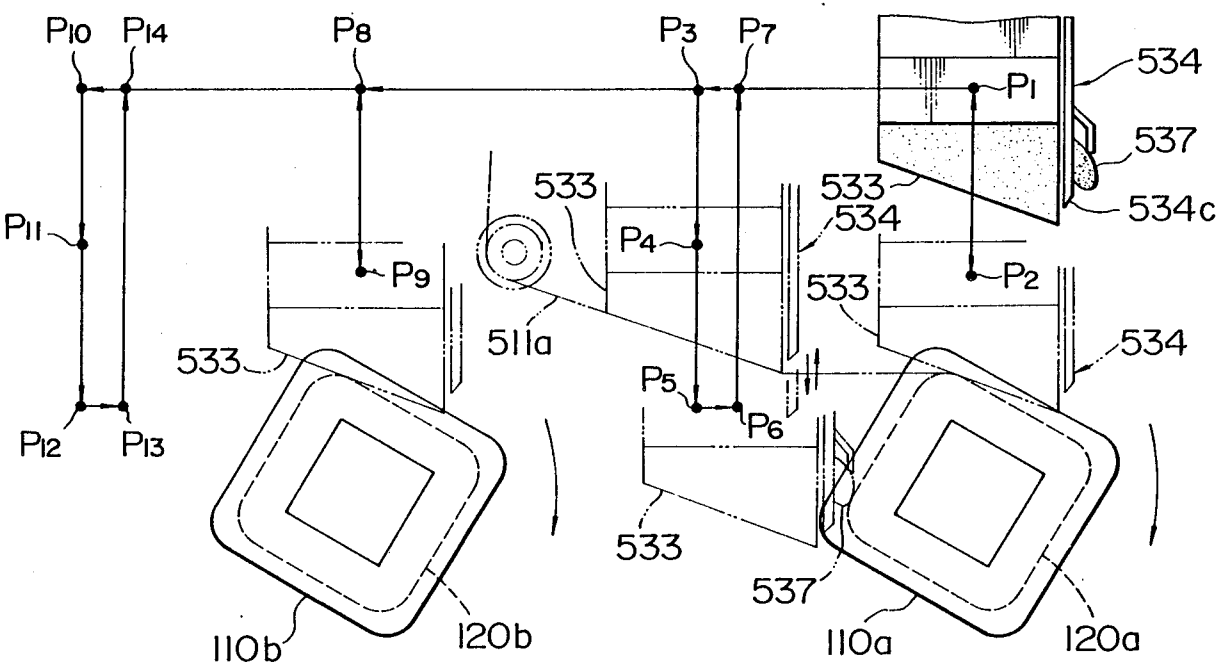
FIG. 7 is a diagram illustrating movement of a tape winding mechanism which is in the process of effecting the tape winding operation.

Using this state as an initial state, in FIG. 7, the pad 533 and the cutter 534 are depicted with solid lines to indicate their positions relative to one coil bobbin 100*a*. A reference position at this time is indicated by a point $P_1$ in the vicinity of a root of the pad 533. In FIG. 7, the subsequent states of movement from this reference position are denoted by $P_2$, $P_3$, . . . $P_{14}$ which correspond to point $P_1$.

First, the tape winder base 400 moves downwardly (from point $P_1$ to $P_2$), and the pad 533 attaches the end 511*a* of the tape 511 to the coil 120*a* wound around the coil bobbin 110*a* (the state shown in FIG. 6*a*).

Figure 6B:
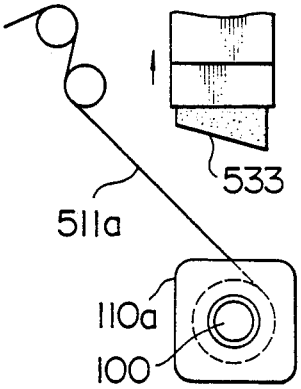

Next, the pad 533 retracts (by moving from $P_2$ to $P_1$), and the spindle 100 rotates clockwise as viewed in FIG. 6*b* and winds the tape 511 around the outer periphery of the coil 120*a* wound around the coil bobbin 110*a* (the state shown in FIG. 6*b*).

Figure 6C:
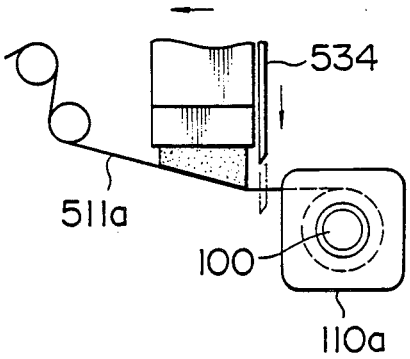

After the spindle 100 rotates a predetermined number of turns, the rotation of the spindle 100 stops. Subsequently, the tape winder base 400 moves in the horizontal direction (from point $P_1$ to $P_3$ in FIG. 7) and assumes the state of FIG. 6*c*. In this state, the air cylinder 522 is driven, and the cutter 534 projects to the position shown by the two-dot chain lines in FIG. 6*c* via the cutter driving plate 523 shown in FIG. 4 so as to cut the tape 511.

Figure 6D:
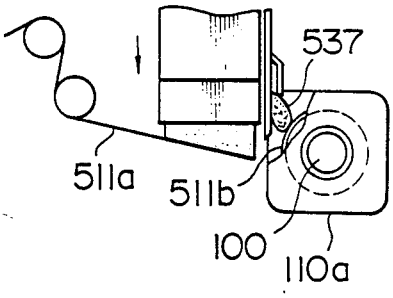

After the tape 511 is cut, the tape winder base 400 moves downwardly (from point $P_4$ to $P_5$ in FIG. 7), and the rubber pad 537 is pushed against the tape 511*b* applied to the coil 120*a* (the state of FIG. 6*d*). In this state, if the spindle 100 is rotated a number of turns, the tape 511*b* can be fixed to the coil 120*a*.

When the tape winding for one coil bobbin 110*a* is completed, the tape winder base 400 moves upwardly (from point $P_6$ to $P_7$ in FIG. 7), moves horizontally to immediately above an adjacent coil bobbin 110*b* (from point $P_7$ to $P_8$ in FIG. 7), and further moves downwardly (from point $P_8$ to $P_9$ in FIG. 7), and the pad 533 attaches the end of the tape 511 to another coil 120*b* wound around a coil bobbin 110*b* (a state similar to that shown in FIG. 6*a*) in the same way as with the coil bobbin 110*a*.

Subsequently, the pad 533 retracts (by moving from point $P_9$ to $P_8$), and the spindle 100 rotates clockwise as viewed in FIG. 6*b* and winds the tape 511 around the outer periphery of the coil 120*b* wound around the coil bobbin 110*b* (a state similar to that shown in FIG. 6*b*).

When the spindle 100 rotates a predetermined number of turns, the rotation of the spindle 100 stops. Subsequently, the tape winder base 400 moves horizontally (from point $P_9$ to $P_{10}$ in FIG. 7), and further moves downwardly (from point $P_{10}$ to $P_{11}$), thereby assuming a state similar to that shown in FIG. 6*c*. In this state, the air cylinder 522 is driven, causing the cutter 534 to cut the tape 511.

After the tape 511 is cut, the tape winder base 400 moves downwardly (from Point $P_{11}$ to $P_{12}$ in FIG. 7), and further moves horizontally (from point $P_{12}$ to $P_{13}$ in FIG. 7), and the rubber pad 537 is pressed against the tape 511*b* applied to the coil 120*b* (a state similar to that shown in FIG. 6*d*). In this state, if the spindle 100 is rotated a number of turns, the tape 511*b* can be secured around the coil 120*b*.

When the tape winding is completed for the coil bobbin 110*b*, the taped winder base 400 moves upwardly (from point $P_{13}$ to $P_{14}$ in FIG. 7), and further moves horizontally (from point $P_{14}$ to $P_1$ in FIG. 7), thereby assuming the initial state. Thus, an operation is completed for the adjacent two coil bobbins 110*a* and 110*b* by the use of one set of tape winding mechanism 500. If this taping is conducted to apply an internal tape in an intermediate stage of coil winding, the coil winding operation is continued after the taping. The tip 511*a* of the tape 511 is held by the suction of the pad 533 until the next taping is performed.

According, the operation of pulling out the tip 511*a* of the tape 511 to the position of the pad 533 may be effected only when the tape 511 is initially loaded on the tape support 510 and when the tape 511 is replaced when it has been consumed.

It should be noted that while this embodiment uses four sets of the tape support 51 and the corresponding winding mechanisms, any number of sets may be mounted. In addition, while the ratio of the number of tape winding mechanisms 500 to the number of spindles 100 is set to four sets to eight spindles, i.e., on to two, in this embodiment, another ratio, e.g., one to three, will also suffice. In the first case, if the number of tape winding mechanisms 500 is given by $n$ and the number of spindles 100 by $m$, then $m \geqq 2n$, where both $n$ and $m$ are integers. As for this ratio, an appropriate ratio is determined taking account of the minimum interval between the adjacent spindles and the outer diameter of the tape roll.

Figure 8A:
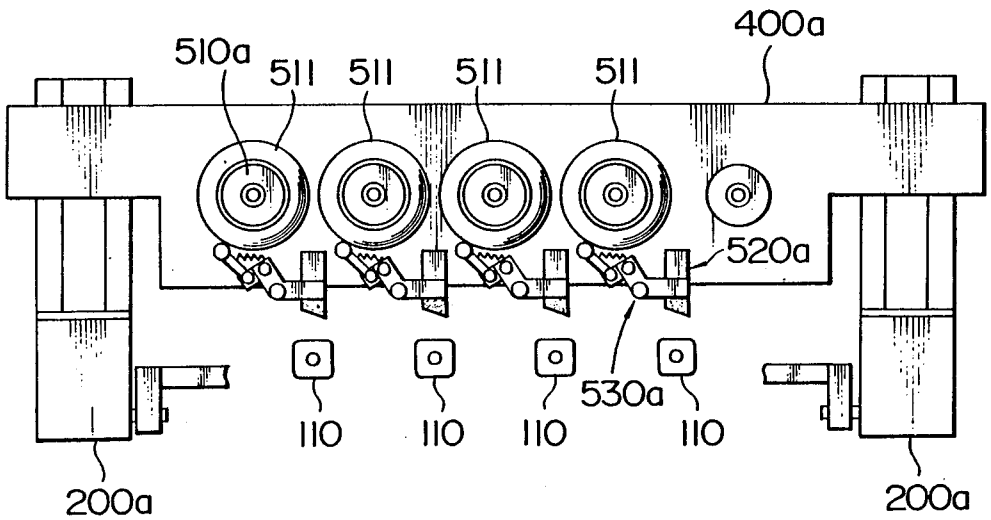
FIG. 8*a* is a front elevational view of another embodiment of the coil winding machine in accordance with the present invention.
Figure 8B:
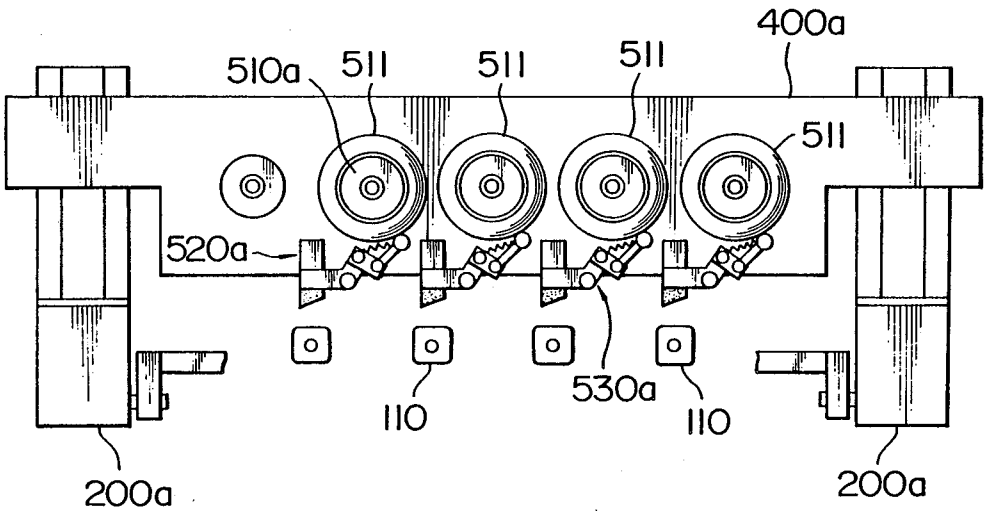
FIG. 8*b* is a front elevational view of the coil winding machine shown in FIG. 8*a*, illustrating a state in which the installing position of the tape winding mechanism is varied.

FIGS. 8*a* and 8*b* show another embodiment of the present invention. In FIG. 8*a*, a tape winder base 400*a* is installed on a pair of nozzle holder support 200*a* in such a manner as to span them and to be vertically movable. Five tape supports 510*a* and four taping head supports 520*a* and installed on the tap winder base 400*a*. In general, if the number of tape supports 510*a* is given by $p$, then $p=m+1$. A taping head 530*a* is detachably provided at each of the taping head supports 520*a*. The arrangements of the tape supports 510*a*, the taping head supports 520*a*, and the taping heads 530*a* are similar to those of the corresponding portions shown in FIGS. 4 and 5.

In FIG. 8*a*, four out of the five tape supports 510*a*, excluding the one disposed at the right-hand end, are loaded with the tapes 511, and the taping head supports 520*a* corresponding therewith are located at the lower right of the tape supports 510*a*, respectively. In this state, the coil bobbins 110 rotate clockwise to effect the taping operation.

FIG. 8*b* shows another state of the coil winding machine shown in FIG. 8*a*, and four out of the five tape supports 510*a*, excluding the one disposed at the left-hand end, are loaded with the tapes 511. The taping heads 530*a* are set inversely by being rotated 180 degrees with the axis of the bar-shaped projections as centers. Accordingly, in a manner contrary to the case of FIG. 8*a*, the corresponding taping head supports 520*a* are located at the lower left of the tape supports 510*a*, respectively. In this state, the coil bobbins 110 rotate counterclockwise to effect the taping operation.

The coil winding machine in accordance with this embodiment is suitable for producing a large variety of coils in small quantities. Namely, if the type of coil changes, e.g., if the tape width or the winding direction of the tape changes, it is possible to replace the detachable taping heads 530*a* and/or change the direction of installation thereof in correspondence with such change.

Although the preferred embodiments of the present invention have been described above, the present invention is not restricted to those embodiments, and various modifications are possible without departing from the spirit of the present invention.

What is claimed is:

1. A coil winding machine having a tape winder, comprising:

a plurality of rotatable spindles capable of holding coil bobbins;

nozzle holder support means for supporting a nozzle holder holding a plurality of nozzles for guiding wires to said coil bobbins, respectively;

a tape winder base, said tape winder base being movable at least vertically relative to said nozzle holder;

means for moving said tape winder base vertically relative to said nozzle holder; and a plurality of tape winding mechanisms provided on said tape winder base, each of said tape winding mechanisms including a tape support for supporting a tape, a tape guide mechanism having a plurality of rollers, a pad for pressing said tape against a coil disposed on said coil bobbin, and a retractable cutter provided adjacent to said pad.

2. A coil winding machine according to claim 1, which further comprises means for moving said tape winder base horizontally with respect to said nozzle holder.

3. A coil winding machine according to claim 2, wherein said means for vertically and horizontally moving said tape winder base includes an intermediate support plate provided on said nozzle holder support means and being vertically movable with respect thereto, said tape winder base being supported by said intermediate support plate and being horizontally movable with respect thereto.

4. A coil winding machine according to claim 2, wherein the number of said tape winding mechanisms in one to an integer of the number of said spindles.

5. A coil winding machine according to claim 1 wherein the number of tape winding mechanisms is given by $n$ and the number of spindles is given by m, and wherein $m \geqq 2n$, both $n$ and $m$ being integers.

6. A coil winding machine according to claim 1, wherein the number of tape supports is given by P and the number of spindles is given by m, and wherein $p=m+1$, both $p$ and $m$ being integers, each of said tape winding mechanisms further comprising a taping head support and a taping head, the taping head being detachable from the taping head support in each of said tape winding mechanisms.

7. A tape winding mechanisms comprising:

a plurality of tape supports provided on a base which is movable at least to an arbitrary position within a plane perpendicular to a rotatable spindle capable of holding a coil bobbin;

means for moving said plurality of tape supports;

a plurality of taping head supports secured to said base, each being provided with a hole;

a plurality of taping head, each including a pad for pressing a tape against a coil wound around said coil bobbin, said pad having a plurality of air holes communicating with a pad surface;

a bar-shaped projection capable of fitting with said hole of said taping head support and having an air suction hole which communicates with said air holes; and a cutter provided adjacent to said pad;

means for advancing and retracting said cutter with respect to said pad; and means for allowing each of said taping heads to engage detachably with an associated taping head support.

* * * * *